US007036670B2

(12) United States Patent
Lam

(10) Patent No.: US 7,036,670 B2
(45) Date of Patent: May 2, 2006

(54) CLOTH DRYING APPARATUS

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 0 days.

(21) Appl. No.: 10/339,021

(22) Filed: Jan. 8, 2003

(65) Prior Publication Data

US 2004/0129659 A1 Jul. 8, 2004

(51) Int. Cl.
*A47F 7/19* (2006.01)
*A47F 7/22* (2006.01)
*A47F 7/24* (2006.01)

(52) U.S. Cl. ..... 211/85.3; 211/189; 211/195; 211/183; 34/239

(58) Field of Classification Search ..... 211/85.3, 211/180, 189, 183, 195; D32/58, 59; 248/158, 248/687; 34/523, 90, 94, 95, 103, 611, 615, 34/618, 619, 621, 192–194, 237, 239, 209, 34/210, 220, 240; 223/69, 94, 85, 89, 88, 223/120, 1, 70, 71
See application file for complete search history.

(56) References Cited

U.S. PATENT DOCUMENTS 1,073,729 A * 9/1913 Barnard ..... 34/93
2,084,854 A * 6/1937 McCarthy ..... 108/31
2,521,100 A * 9/1950 Sublette ..... 223/69
2,599,199 A * 6/1952 Roberts ..... 223/69
2,854,178 A * 9/1958 McDowall et al. ..... 223/69
3,003,248 A * 10/1961 Wittie ..... 34/95
3,040,903 A * 6/1962 Crews ..... 211/119
3,103,422 A * 9/1963 Green ..... 34/238
3,307,712 A * 3/1967 Kurz ..... 211/195
3,381,864 A * 5/1968 Shields ..... 223/69
3,477,155 A * 11/1969 Feld et al. ..... 38/102.9
4,429,928 A * 2/1984 Sullivan ..... 312/31
4,538,365 A * 9/1985 Aho ..... 34/239
4,592,473 A * 6/1986 Efrom ..... 211/205
4,730,737 A * 3/1988 Robinson ..... 211/113
4,739,888 A * 4/1988 Steiner ..... 211/198
4,777,737 A * 10/1988 Wolens et al. ..... 34/237
4,794,743 A * 1/1989 Lehneis
4,828,123 A * 5/1989 Basore ..... 211/202
4,862,602 A * 9/1989 Krill ..... 34/239
4,894,935 A * 1/1990 Kretz ..... 38/137
5,372,266 A * 12/1994 Fisher ..... 211/189
5,397,037 A * 3/1995 Ozawa ..... 223/94
5,397,038 A * 3/1995 Hunt ..... 223/95
5,555,648 A * 9/1996 Griffin ..... 34/621
5,667,081 A * 9/1997 Pund-Hogan ..... 211/10
5,901,888 A * 5/1999 Schneider et al. ..... 223/89
5,906,277 A * 5/1999 Vienneau ..... 206/315.1
6,153,862 A * 11/2000 Job ..... 219/521
6,644,520 B1 * 11/2003 Lam ..... 223/94
6,922,911 B1 * 8/2005 Lam ..... 34/239

* cited by examiner

*Primary Examiner*—Jennifer E. Novosad

(57) ABSTRACT

A garment drying apparatus (200) is provided having a frame (201), a porous net (204), an adjustable width garment hanger (202) and a hook (203) to support said adjustable width garment hanger; slip proof pads (205,206) are provided to support said frame to rest at an acute angle from the floor.

25 Claims, 7 Drawing Sheets

CLOTH DRYING APPARATUS

FIELD OF THE INVENTION

The present invention relates to an apparatus configured for drying washed cloth naturally.

BACKGROUND OF INVENTION

Delicate garment are hand washed and air-dried. The prior art is replete with various configurations of laundry hangers and drying racks, which dry clothing naturally in the air or under the sun. Applicant's pending U.S. patent application Ser. No. 10/041,434 discloses a low cost, moisture resist adjustable garment hanger suitable for drying wet garment and better maintaining the garment shape.

SUMMARY OF THE INVENTION

Used and soiled clothes are mostly cleaned by dry cleaning or by a water washing process. Dry clean clothing in volume is relatively expensive as compared with washing clothing by water. There are also evidences that the traditional dry cleaning process is causing environmental issues. While most clothes are water washed by washing machine and then dried with a heated dryer, the rotational and spinning motions of a washing machine and cloth dryer contribute to a harsh environment that easily damages delicate clothing. In addition, the elevated temperature of a dryer is also causing shrinkage of clothing made by cotton and many other commonly used fabric materials. Accordingly, hand wash and air-drying is still a popular way to clean delicate clothes.

The present invention is directed to an improved garment drying apparatus configured for significantly reducing deformation of the garment caused by traditional air-drying process.

According to one aspect of the present invention, it is provided a supporting frame made of plastic tube or metallic rods. In an exemplary embodiment, four segments of supporting rods are connected end to end to form a square or rectangular frame. The junctions of the rods are designed for fast attach or release by consumers to transform between a larger size drying mode and a reduced size storage mode. A garment hanger having a medial portion and two supporting arms extending at an obtuse angle from said medial portion is fixedly attached to the central position of the upper rod. Alternately the upper location of the frame is provided a receiving member structured to receive the hook, or the suspension member of a separated garment hanger. This receiving member is positioned around the center location of the upper supporting rod. A sheet of porous material such as a fabric net is stretched and mounted in between the supporting rods. At the bottom of the frame are slip proof pads provided to prevent the frame to skid against the floor. The frame is designed to rest at an acute angle from the supporting floor, within an angular range between 45 degree to 80 degree. In a preferred embodiment, the frame is configured to rest against a wall to provide the resting angle defined. If a supporting wall is not available, other supporting structure is provided behind the supporting frame so that it can rest at an angle from the floor, or a supporting surface.

Washed wet cloth without being squeezed or twisted, is gently hung on a waterproof garment hanger positioned around the upper edge of the frame. Wood hanger is not recommended due to the wet nature of the clothing supported. Metal wire hanger that tends to rust is also not suitable for this application. If the supporting hanger is a separated external hanger, the wet cloth is properly arranged on the hanger before it is attached to the receiving member located at the upper central position of the supporting frame. The next step is to evenly stretch and spread the wet cloth on the surface of the porous supporting sheet. Because of the surface tension provided by the water content of the wet cloth, the wet cloth will adhere firmly to the porous sheet until it is dried. The supporting frame is then rest at an acute angle from a supporting surface, such as a floor or a bathtub. The time required for this natural drying process depends on the relative humidity of the environment, the speed of air movement around and the amount of sunlight available. During the initial period of this natural drying process, water content of the wet cloth starts to cumulate at the bottom portion of the cloth due to gravitational force. When a wet cloth is supported by a regular hanger and air dried as in the traditional drip dry process, the high water content cumulated at the bottom of the cloth creates a high downward pulling force that may damage the fabric of the cloth. This lasting downward pulling force significantly deforms the shape of the cloth after it is dried. When a fixed width garment hanger is used in the traditional drying process, it is impossible for a single hanger to provide a supporting width that always perfectly matches the shoulder dimensions of different clothing sizes. As a result, ugly looking dents caused by the high downward pulling force are found at the shoulder areas of the cloth after it is dried. Accordingly it is another goal of this invention to provide a one stop, deformation free solution for the natural air-drying process.

In order to achieve this goal, a perfect adjustable width garment hanger is provided with the invented drying frame to form a retail package. The garment hanger is preferred to be adjustable from XS size to XXL sizes, so that clothes of all sized can be dried with the retail package provided. The adjustment mechanism is structured to provide the same amount of extension adjustment to both shoulder arms of the hanger. The preferred adjustment mechanism also allows the hanger to be adjusted to any required supporting width, instead of providing different preset steps of adjustment dimensions. Furthermore, the adjustable hanger is preferred to be adjustable while the wet cloth is put on the hanger.

In a preferred embodiment, the adjustable width garment hanger integrally assembled with the dryer frame, or packaged with the retail kit to form a perfect air-drying solution is equipped with an adjustment mechanism located at the medial portion of the hanger. This mechanism translates the movement of a moving hanger arm located at one side of the hanger, to the moving hanger arm located on the other side of the hanger. Alternatively, the adjustment mechanism is also equipped with an adjustment knob located at the medial portion of the hanger. Both moving hanger arms are moved inward or outward by the same amount when the adjustment knob is turned. These types of adjustment mechanisms are defined as a reciprocal adjustment mechanism in this invention. A reciprocal adjustment mechanism controlled by a centralized adjustment knob has a significant advantage that it allows the supporting width of the drying hanger to be adjusted for a perfect fit after the wet cloth is put on the drying hanger. In a preferred embodiment disclosed in applicant's pending U.S. patent application Ser. No. 10/041,434, two flexible tongues having gears facing in opposite directions are connected to each of the movable supporting arms of the hanger. The gear tongues are then coupled to a gear mechanism that translates the motion of one movable arm to another. An adjustable knob located at the medial portion of the hanger is coupled to one of the adjustment gear so that the hanger width can be adjusted by rotating the adjustment knob.

According to another aspect of the present invention, a thin sheet of porous material is pre-assembled at the factory together with at least one the supporting rods. The porous sheet is then wrap around the bundled supporting rods to form a space saving packaging for retail purpose. In yet another embodiment the porous sheet is folded separately at the factory. Releasable Velcro attachments positioned around the edges of the porous sheet can be provided to facilitate the user to assemble the frame for a drying mode or disassemble the unit to form a smaller size storage mode. The porous sheet is defined as a sheet of material that allows air and water to pass through. Typical examples of porous sheet are nylon net or other porous fabric material suitable for manufacturing laundry accessories. A container is provided at the bottom of the drying frame to collect the water flowing downward along the porous sheet.

Following is a disclosure of the working principle of this improved drying apparatus that supports the wet cloth at an angle on a porous sheet. During the earlier stage of the drying process, instead of cumulating water at the bottom portion of the cloth, water content of the cloth is directed to the porous sheet and continues its drain along the porous sheet to the container beneath. The porous sheet provides a continuation downward flowing path for the water content that is driven by gravitation force. Drawing the concentration of water content away from the lower portion of the wet cloth significantly reduce the deformation issue and speed up the air-drying process. Since the wet cloth is properly shaped to stick with the porous sheet behind, it is often found that the cloth is in perfect shape and iron free after drying. The inclined angle of the drying frame is important. If the drying frame is positioned at 90 degree from the horizontal ground, like a picture frame, the process to direct the water content of the wet cloth to the porous sheet is inefficient. If the drying frame is positioned completely horizontal, most of the water content of the wet cloth will spread evenly around at the opposite side of the porous sheet and stay there instead of being directed into the collecting container. Therefore the drying time will take much longer. The optimal angle is to have the frame positioned close to 90 degree from the horizontal level but not exactly vertical. Since the addition of the wet cloth to the front side of the support frame shifted the center of gravity of the frame towards the front side, a selection of angle between 45 degree to 80 degree will provide reasonable satisfactory result.

In yet a further embodiment, multiple drying frames are arranged to be stacked one on top of another so that several clothes can be dried at the same time without occupying too much space. The slip proof bottom pads or the water collection container are shaped to accept multiple drying frames and keep the space therebetween. Properly designed spacer is also required at the upper portion to maintain the space between the frames. In an alternate design, the receiving member that receives the hook of the air-drying hanger is shaped to provide the spacer function.

If the drying apparatus is used outdoor, it is important to have the wet cloth firmed attached to the drying frame so that it will not be blown away by wind. Reliable frame supporting design and/or heavier dummy weight located at the bottom of the drying apparatus are also required to prevent the whole drying frame to be blown away. In a preferred embodiment to serve this purpose, the suspension member, or the hook of the drying hanger is designed to be in a close loop shape. The suspension member of the hanger is then unremovably attached to the receiving member. At the bottom of the frame two clips are provided to secure the bottom portion of the wet cloth. The clips are attached to the lower portion of the frame either being an integral part of the frame or connected by a string. It should be noted that the embodiments described are exemplary to implement the disclosed theory and different alternate designs can be provided according to the spirit of the invention.

From the foregoing, an invention is disclosed to provide a retail kit of universal drying apparatus to perfectly air-dry delicate clothes of different sizes. The novel features of the invention are set forth with particularity in the appended claims. The invention will be best understood from the following description when read in conjunction with the accompanying drawings.

DESCRIPTION OF THE PREFERRED EMBODIMENTS

Figure 1:
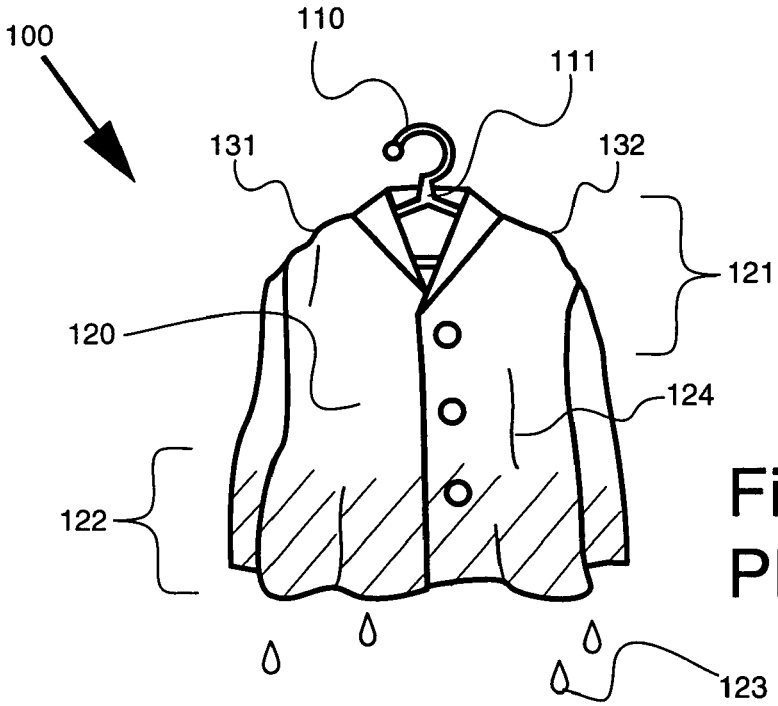
Figure 1 PRIOR ART
FIG. 1 illustrated prior art method of drying delicate clothing by a traditional garment hanger.

FIG. 1 is the front view of a prior art air-drying set up. A standard size hanger 111 having a suspension member 110 supports a wet cloth 120 for air dry. The wet cloth 120 is made of delicate material such as wool or knitwear. In order to avoid unnecessary wrinkling, the wet cloth 120 is not squeezed or twisted before the air-dry process. During the first early stage of the drying process, water content of the wet cloth is drawn to the lower portion 122 of the cloth by gravitational force. Excess water that exceeds the surface tension of water becomes droplets 123 and fall to the ground. At a second early stage of the air-drying process, no more water is able to become droplets. The drying process is now relying on evaporation. During this stage, the lower portion 122 of the wet cloth 120 is still soaked with water content absorbed by the fabric. This stage will last for several hours until the water content is fully evaporated. The rich water content cumulated at the lower portion of the wet cloth creates a heavy downward pulling force for an extended time. This pulling force not only pulls the wet cloth into a longer vertical shape particularly at the upper region 121, it also creates vertical wrinkle lines 124 and shoulder marks 131, 132 to the cloth. Standard size hangers 111 are used for most of the households during the traditional air-drying process. The high downward pulling force is particularly harmful to the shoulder portion of a wet cloth due to three reasons. Firstly, the hand wash and air-drying process is applied mostly to clothes made of delicate materials. These materials have a much higher tendency to suffer from significant deformation damage when being supported by a hanger of improper size and then pulled downward with a heavy force for an extended time. Secondly, most fabric materials tend to be soft and easy to reshape when it is wet. The shape is then set when a wet cloth becomes dry. Therefore the dent mark is particularly significant and difficult to recover after the air-drying process. Thirdly, the hanger supports only the shoulder portion of the wet cloth. All the weight of the wet cloth including the heavy water content beneath becomes pulling force concentrated along this shoulder line for an extended time. It is the objective of this invention to provide a perfect air drying apparatus that works with clothes of different sizes and eliminate all the draw backs of the traditional air-drying set up without scarifying the drying time.

Figure 2A:
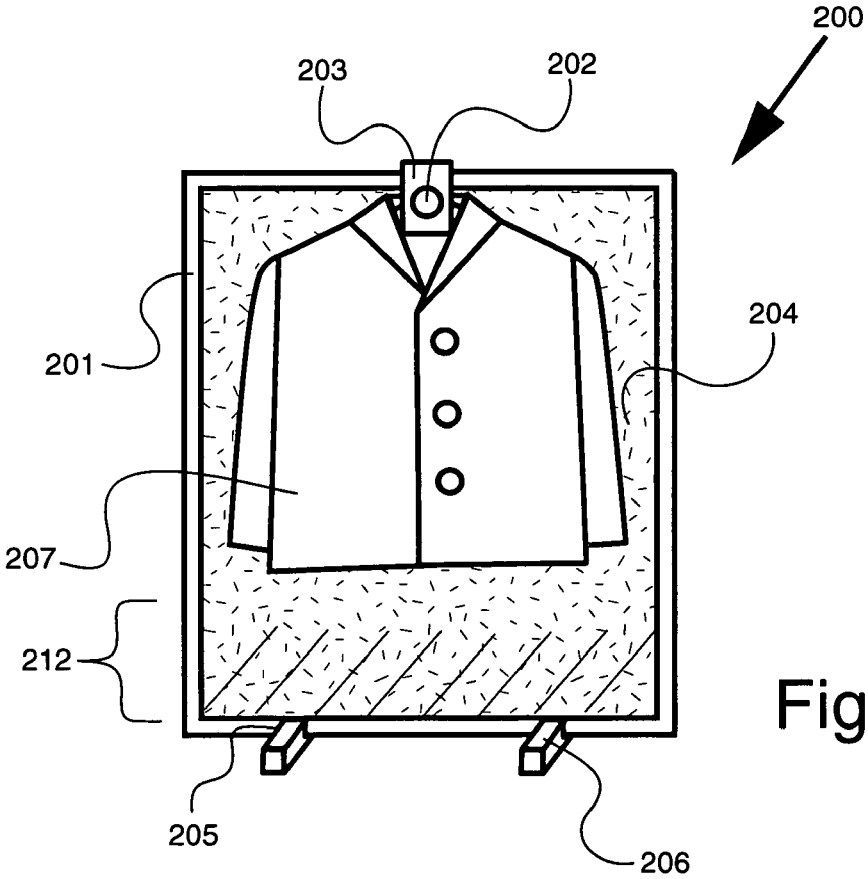
FIG. 2A is a front view to illustrate a preferred embodiment of the subject invention with a wet garment properly arranged on the porous drying sheet.

FIG. 2A illustrates an improved apparatus 200 provided for air-drying a wet cloth 207. The air-drying apparatus comprises a frame 201, which supports a thin porous sheet 204. At the top of the frame 201 is an adjustable hanger 203 extended from the upper edge of the frame 201. A knob 202 is provided to adjust the supporting shoulder width of the hanger in order for it to perfectly support the wet cloth 207. At the bottom of the frame 201 are the slip proof pads 205, 206 and 233. During the drying process, water is moved to the lower portion 212 of the porous sheet by gravitational force.

Figure 2B:
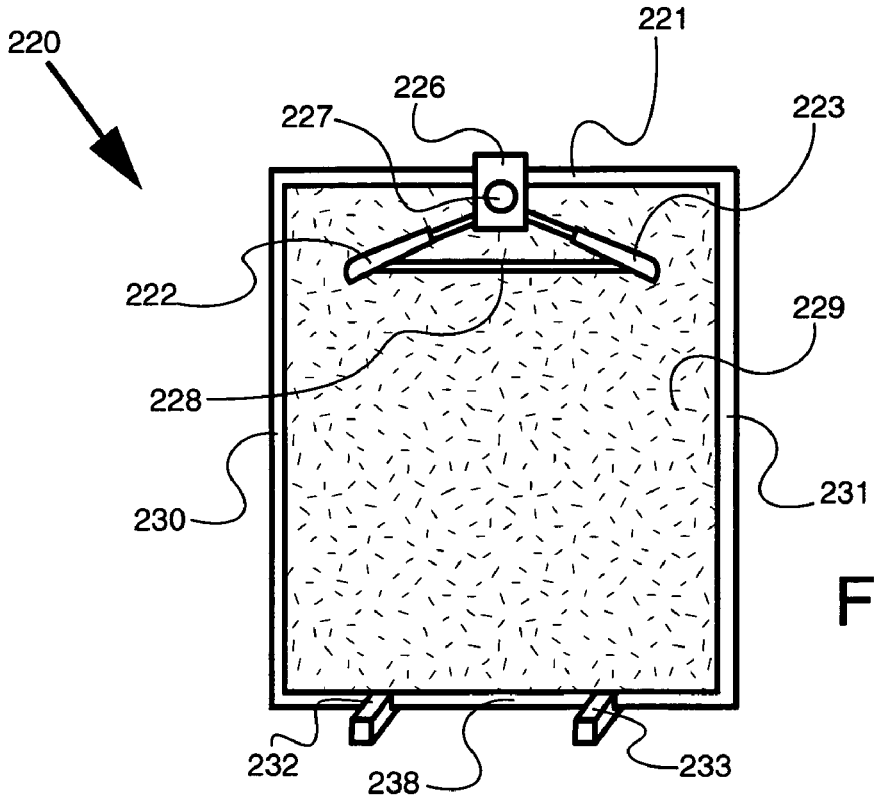
FIG. 2B illustrates the front view of the embodiment shown in FIG. 2A without the garment.
Figure 2C:
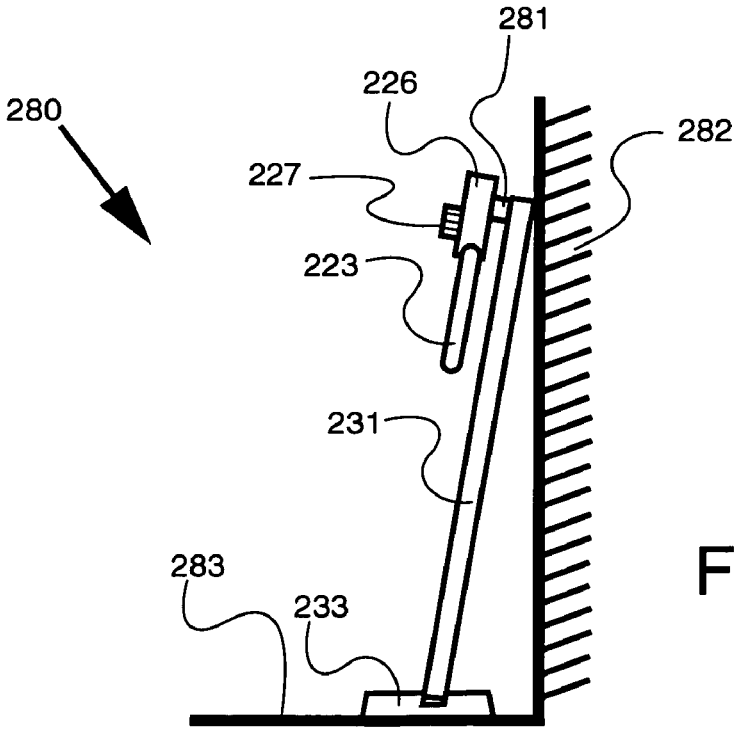
FIG. 2C illustrates the side view of the embodiment shown in FIG. 2B.

FIG. 2B illustrates the embodiment of FIG. 2A without the wet cloth attached. FIG. 2C illustrates the side view of the embodiment 280 shown in FIG. 2B. The frame 220 comprises an upper edge 221, a bottom edge 238 and side edges 230 and 231. In between is the porous sheet 229. It can be observed that the medial portion 226 of the adjustable hanger extends from the upper edge 221 of the dryer frame. Beneath the medial portion are the adjustable moving arms 222 and 223 that travel along the supporting arms of triangular hanger frame 228. The knob 227 is coupled with the internal mechanism that adjusts the position of the moving arms 222 and 223. A receiving portion 281 is provided to assemble the hanger 228 with the upper portion 221 of the frame and providing a room between the frame and the hanger for the wet cloth to be put in. The frame 231 is configured to rest on the surface 283 and against a supporting surface 282.

Figure 3:
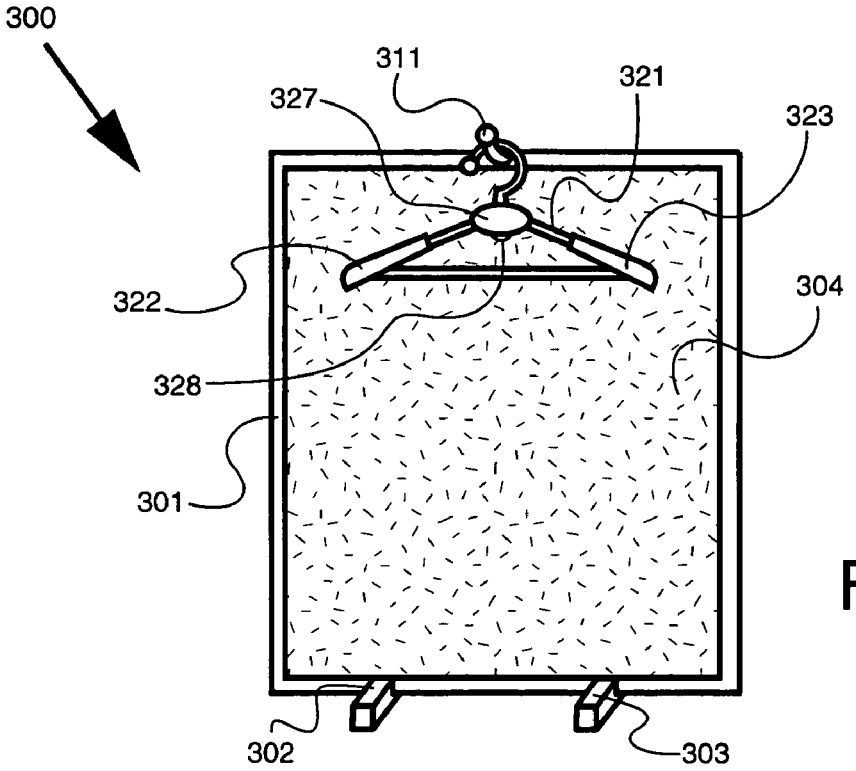
FIG. 3 illustrates the components included in a retail packaging of the subject invention as a total solution to address the problems faced by the traditional air-dry set up.

FIG. 3 demonstrates an alternate embodiment 300 that provides a receiving means 311 extended from the upper edge of the dryer frame. This receiving means accepts the suspension member of the adjustable hanger 321. This hanger and the slip proof pads 302, 303 are sold separately as options, or packaged with the dryer frame 301 to provide a one stop, total solution for a universal garment air-drying apparatus that is ready to perfectly dry clothes of different sizes.

Figure 8A:
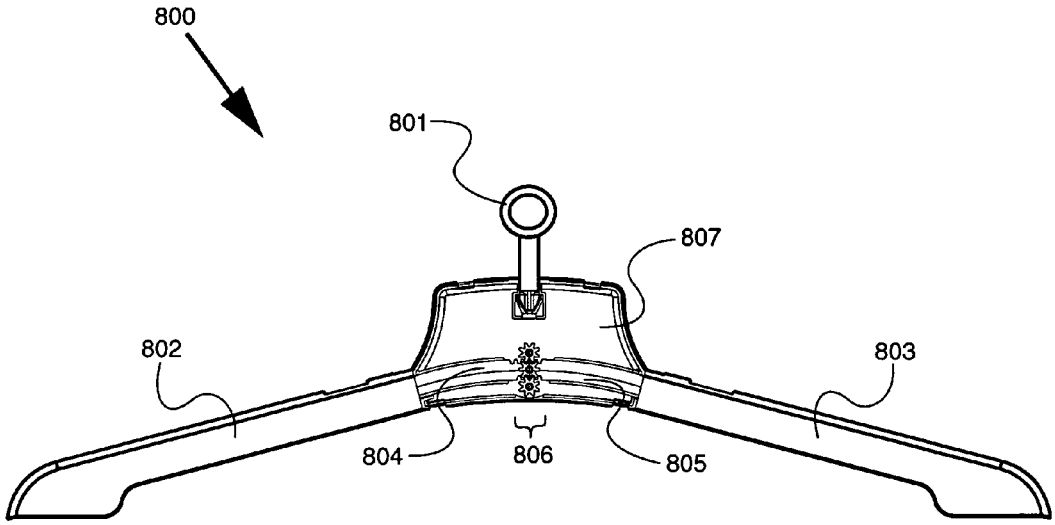
FIG. 8A illustrated an adjustable width garment hanger specially designed to become a member of the drying apparatus retail package invented.
Figure 8B:
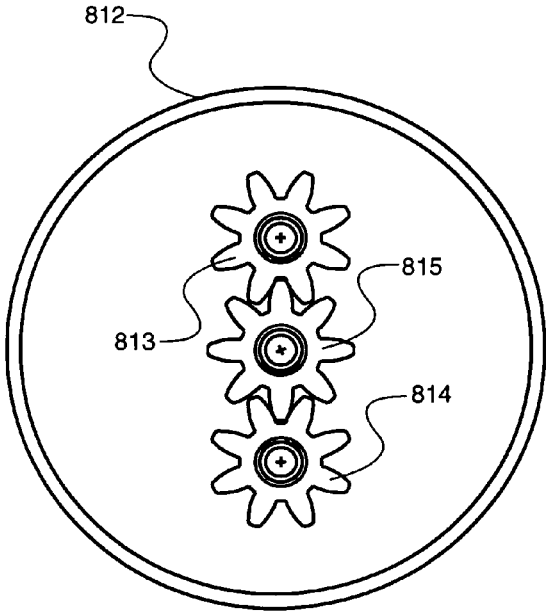
FIG. 8B illustrates the adjustment knob assembly of the adjustable hanger disclosed in FIG. 8A.
Figure 8C:
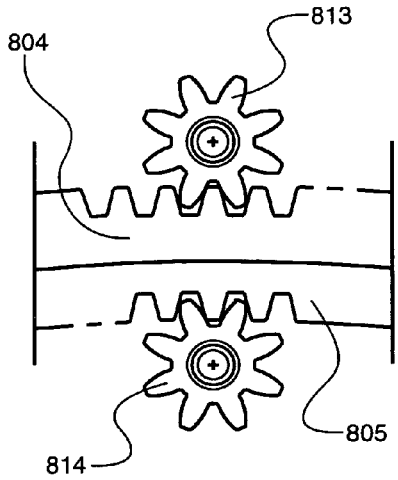
FIG. 8C illustrates the internal working structure of the hanger width adjustment mechanism illustrated in the embodiment of FIG. 8A.

The garment hanger 321 comprises a triangular frame and two movable arms 322 and 323 located at the two sides of the hanger. Beneath the medial portion 327 of the adjustable hanger 321 is a manual adjustment knob 328 that adjusts the movement of the moving arms 322 and 323. The location of the adjustment knob 328 enables the movable arms 322 and 323 of the hanger to be adjusted even when a wet cloth is placed onto the hanger 321. Attention is now directed to FIGS. 8A to 8C, which illustrate the detail mechanical structure of a reciprocal adjustable hanger equipped with an adjustment knob located at the medial location. The hanger 800 comprises a special ring shape suspension member 801, a medial portion 807, two moving arms 802, 803 and a central reciprocal adjustment mechanism 806. The linkage tongues 804 and 805 are connected to the movable arms 802 and 803 respectively. When the upper linkage tongue 804 is moved by pushing the movable arm 802, the motion is translated to the gear 813 as shown in the enlarged FIG. 8C. FIG. 8B illustrates the adjustment gear chain 806 located behind the linkage tongues. It can be observed that the motion of the gear 813 is translated to the central gear 815 and then to the bottom gear 814. Movement of the gear 814 will cause the linkage tongue 805 to drive the movable arm 803 to expand or contract by the same amount. The adjustment knob 812, accessible from the outside of the hanger medial portion, is coupled to the gear 815. This adjustment knob, also represented by the knob 328 as shown in FIG. 3 will move the gears 813, 814 when it is turned. The motion is then transferred to the movable arms 802 and 803 at the same time.

Figure 4:
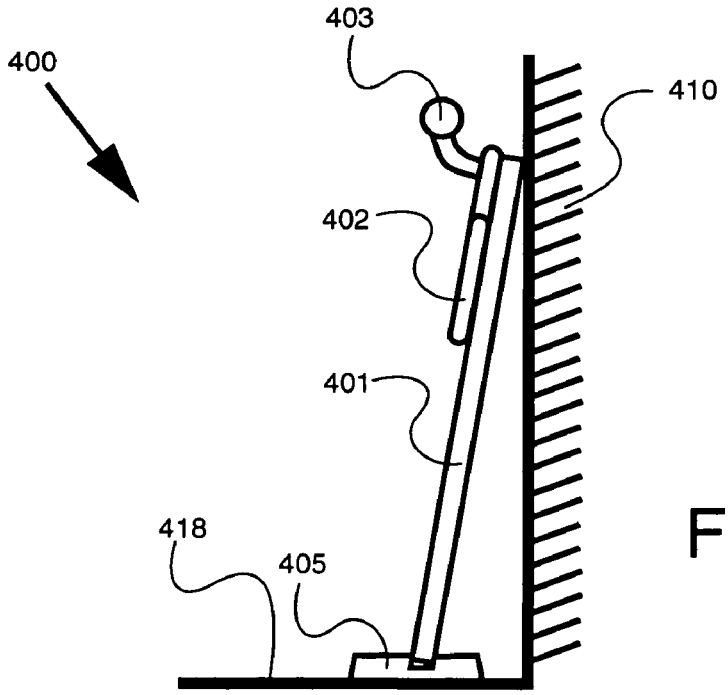
FIG. 4 is a side view of the embodiment shown in FIG. 3.

Attention is now directed to FIG. 4 that shows the side view of the embodiment 400 shown in FIG. 3. The frame 401 is positioned at an angle around 70 degree from the floor 418 and rests against a wall 410. The slip proof pad 405 prevents the frame 401 from slipping along the floor 418. The hanger 402 is received by the receiving means 403

Figure 5A:
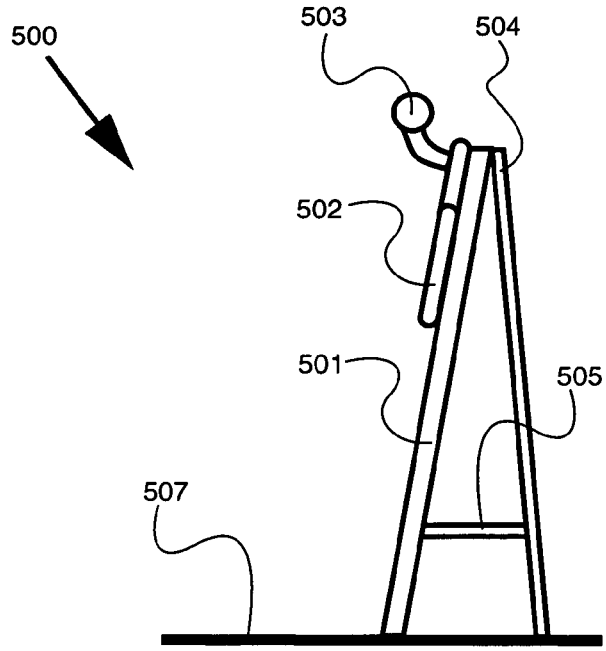
FIG. 5A illustrated an alternate embodiment to support the drying frame at an acute angle from the floor.
Figure 5B:
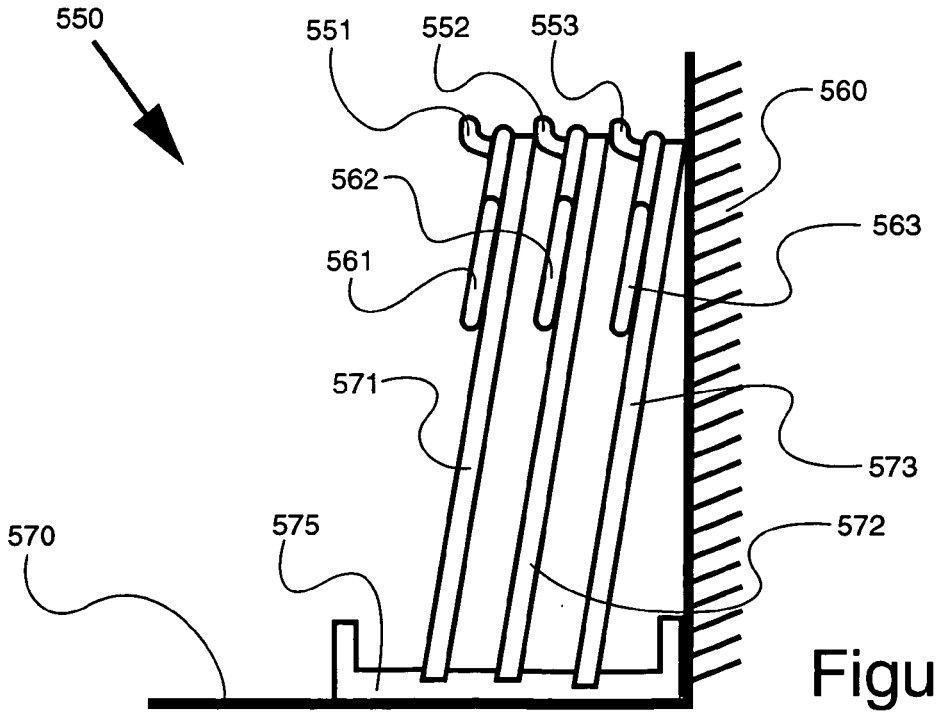
FIG. 5B illustrated a space saving embodiment to air-dry several clothing at a time.

FIG. 5A discloses an alternate structure of the air-drying apparatus 500 that is supported by the rods 504 and 505 instead of resting against a wall. Receiving means 503 of the frame 501 receives the hanger 502. FIG. 5B illustrates an improved set up 550 that allows three supporting frames 571, 572 and 573 to be positioned one in front of another. The container 575 resting on the floor 570 serves two purposes. Firstly it collects water droplets guided by the porous sheets of the three supporting frames. Secondly, it provides slip proof grooves to support the frames. Thirdly, the grooves define the separation distances between the three supporting frames 571 to 573. The upper portion of the supporting frames 571 to 573 and the hangers 560 to 562 are maintained in position separated from each other by the receiving members 551 to 553 and the wall 560.

Figure 9A:
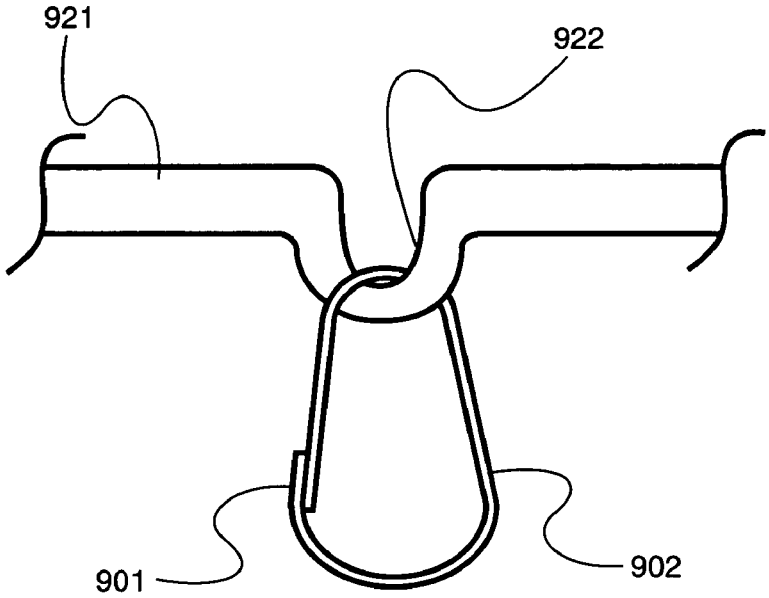
FIG. 9A illustrates the embodiment of a secure receiving member to accept the hook of the hanger disclosed in FIG. 8A.
Figure 9B:
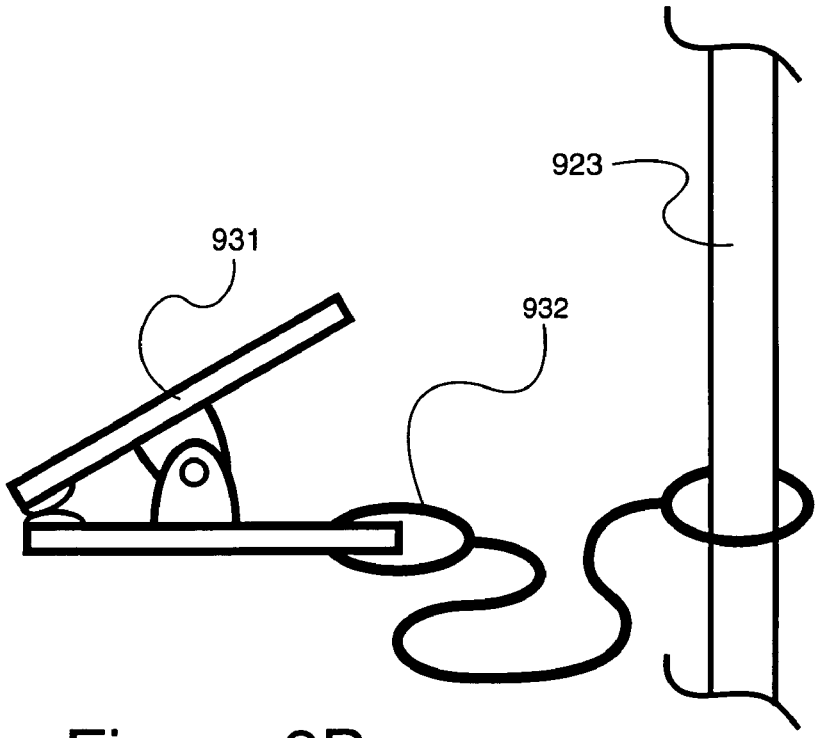
FIG. 9B illustrates example of clip design provided at the bottom region of the supporting frame for securing the lower corner positions of the cloth resting on the drying apparatus.

Attention is now directed to FIG. 9A, which represents an alternative arrangement of the receiving member located at the upper central portion of the supporting frame. The upper horizontal rod 921 of the frame 301 as shown in FIG. 3 is provided a notch 922 at the central position. This notch is an alternative design to represent the receiving means of the frame to accept the hook of a garment hanger. Assembled to the notch 922 is an attachment device 902 having a spring releasable opening 901. The purpose of the attachment device is to securely retain the suspension member of the garment hanger used with the air-drying apparatus. When the close loop suspension member 801 of the specialty garment hanger illustrated in FIG. 8A is engaged with the secure attachment device 902, the releasable opening 901 is closed to a locked position to prevent the garment hanger to be removed unintentionally, such as in a windy situation. The suspension member 801 can be removed only when releasable opening 901 is manually opened. It should be noted that an adjustable hanger integrally assembled with the hanger frame as shown in FIGS. 2B and 2C not only serves the secure attachment purpose described, it also prevents the user from picking any other standard size hanger to use with the drying frame. This is a foolproof set up that prevents the shoulder portion of a drying garment to be deformed. An alternate method to provide a fool proof design is to modify the structure of the embodiment demonstrated in FIGS. 2B and 2C such that the adjustable hanger 228 can be released and reconnected by a special receiving means 281. Because there is no hook provided for the hanger 228, users will not try to remove the adjustable hanger 228 sold with the package. The special close loop suspension member 801 illustrated in FIG. 8A is also capable to serve the same foolproof purpose. To further prevent the drying cloth being blown away by the wind, retainer clips 931 are provides as shown in FIG. 9B. Gripping means represented by two clips are also provided to keep the bottom corners of the cloth in position. The retainer clips 931 are either integrally formed with the supporting frame or attached to the frame by a string 932.

Figure 6:
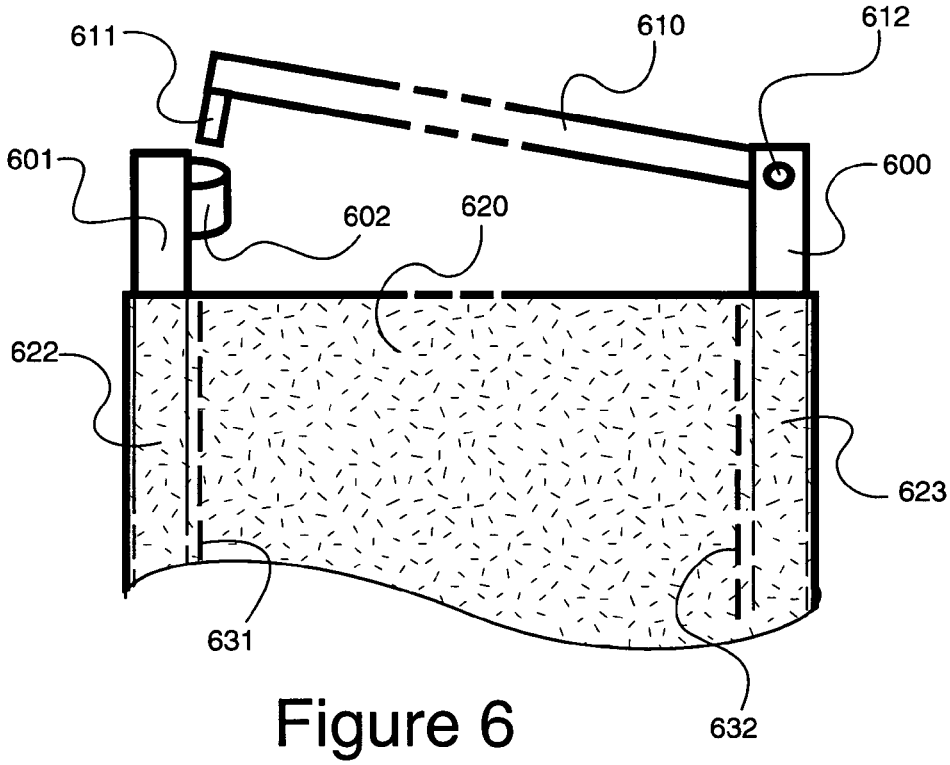
FIG. 6 demonstrates how segments of the drying frame are connected to transform from a storage mode into a drying mode.
Figure 7:
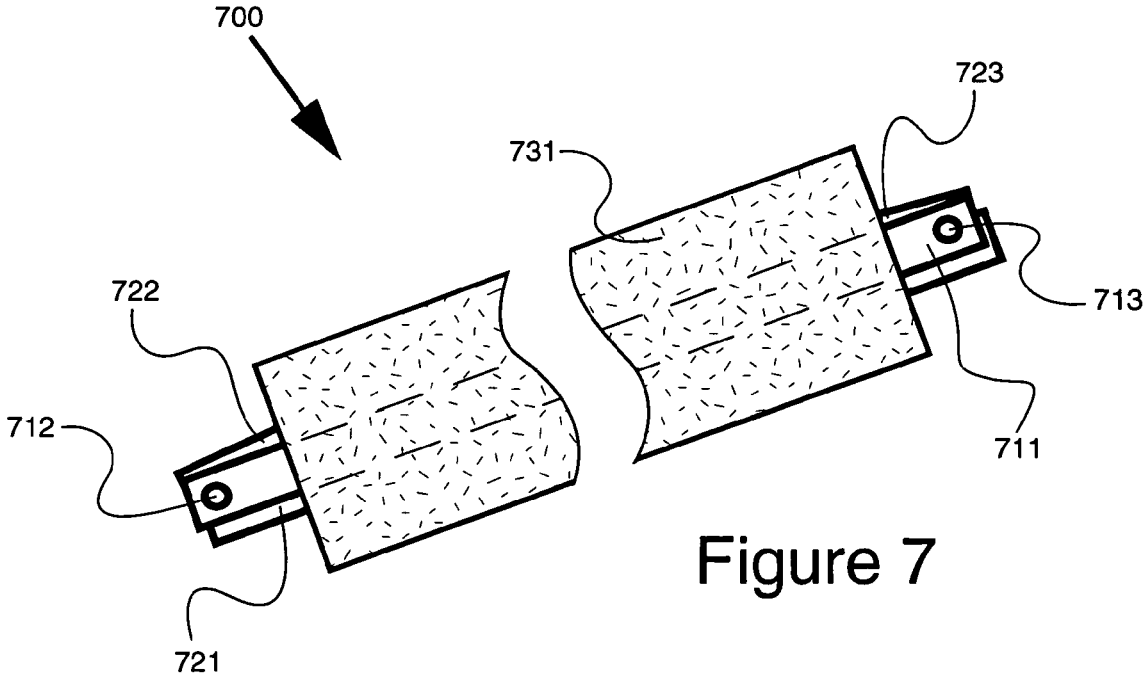
FIG. 7 demonstrates the storage mode of embodiment shown in FIG. 6.

In order to have a drying area adequate to support most lady size garments, the dimension of the garment drying apparatus is recommended not to be less than 20 inches in width and 30 inches in height. A reasonable dimension chosen for household use is 30 inch by 36 inches for the air-drying apparatus to work with clothes size ranges from XS to XXL sizes. It is another goal of the subject invention to provide an air-drying apparatus that can be easily folded by users to form a smaller size storage mode and expanded by users to provide a larger size drying mode. FIG. 6 illustrates a porous sheet 620 pre-assembled with the supporting rods 600 and 601 at the factory. The porous sheet 620 is sewn along the lines 631, 632 for providing the room 622, 623 to receive the supporting rods which hold the frame. The horizontal supporting rod 610 is hinged with the vertical right hand side rod 600. When the air-drying apparatus is in use, the upper horizontal rod 610 is connected between the vertical rods 600 and 601. The catch 602 of the vertical supporting rod 601 accepts the pin 611 of the horizontal rod 620. Upper edge of the porous sheet can be attached to the upper horizontal rod 610 by Velcro attachments. The bottom supporting rod is assembled to form the supporting frame in the same manner. When the air-drying apparatus is not in use, the horizontal rods 722, 723 are released and folded with the vertical rods 711, 721 as shown in the storage mode 700 of FIG. 7. The porous sheet 731 is then wrapped around the bundled rods to form a small size storage mode. Hinges 612, 712 and 713 allow the frame to be converted from the compact storage mode as shown in FIG. 7 to an expanded application mode illustrated in FIG. 6. It should be noted that the embodiments illustrated are exemplary and there are many different ways to form the expanded size drying mode and reduced size storage mode. All these different ways are considered to be within the scope of this invention as allowed by the appended claims.

From the foregoing it should now be recognized that embodiments of a retail kit of air-drying apparatus have been disclosed herein especially suited for eliminating the common problems encountered by the traditional air-drying process. All essential components required to support clothes of different sizes are provided in this total solution air-drying kit.

What is claimed is:

1. A retail packaging configured for drying a cloth comprising:

a frame structured for a user to stretch a porous sheet for supporting a spread out wet cloth for an expanded size drying mode and to release said porous sheet from a stretched condition for a reduced size storage mode;

said frame is further structured to stand at an acute angle from a supporting surface during said expanded size drying mode; and a garment hanger having a medial portion and two supporting arms extending in opposite direction at an obtuse angle from said medial portion.

2. The retail packaging of claim 1 wherein said garment hanger extends from the upper edge of said frame.

3. The retail packaging of claim 1 wherein said porous sheet is further configured to be wrapped with said frame or folded to provide said reduced size storage mode.

4. The retail packaging of claim 3 further comprising at least one slip proof member configured to prevent said frame from slipping against said supporting surface.

5. The retail packaging of claim 1 further comprising water collection means provided for collecting water dripped from said porous sheet.

6. The retail packaging of claim 1 wherein said frame is further configured to allow a second frame and porous sheet assembly of identical structure to cascade with said frame and maintain a defined distance apart from each other.

7. The retail packaging of claim 1 said frame further comprising receiving means located proximate to an upper center portion of said frame for receiving a suspension member of said garment hanger.

8. The retail packaging of claim 1 further comprising gripping means configured to maintain the position of a cloth resting on said porous sheet.

9. The retail packaging of claim 1 wherein said frame is formed by at least four segments of supporting bars connected with each other.

10. The retail packaging of claim 1 wherein said garment hanger further comprises:

first and second movable arms configured to travel along said supporting arms for defining an adjustable garment supporting width; and first and second linkage tongues, each having a remote end connected to said movable arms and a proximal region coupled to the medial portion of said hanger for reciprocally adjusting the position of said movable arms.

11. The retail packaging of claim 1 wherein said garment hanger comprises:

first and second movable arms configured to travel along said supporting arms for defining an adjustable garment supporting width; and a knob located proximate to said medial portion for adjusting the position of said movable arms.

12. A cloth drying apparatus comprising:

a variable size frame;

a porous sheet;

said frame is structured to stretch said porous sheet for an expanded size drying mode and to release said porous sheet from said stretch condition for a reduced size storage mode;

said frame is also structured to stand at an acute angle from a supporting surface during said expanded size drying mode; and receiving means proximate to the upper center portion of said frame for attaching said frame with a garment hanger.

13. The cloth drying apparatus of claim 12 further comprising at least one slip proof member positioned at the bottom of said frame to prevent said frame from slipping along said supporting surface.

14. The cloth drying apparatus of claim 12 further comprising water collection means positioned to collect water dripped from said porous sheet.

15. The cloth drying apparatus of claim 12 further comprises a garment hanger connected to said receiving means.

16. The cloth drying apparatus of claim 15 wherein said receiving means is further configured to lock the position of said garment hanger when it is attached to said frame.

17. The cloth drying apparatus of claim 12 wherein said frame defines a first drying rack, said cloth drying apparatus further comprises a second drying rack having a second variable size frame and a second porous sheet; wherein said second drying rack stacks in front of said first drying rack while maintaining a defined distance apart.

18. The cloth drying apparatus of claim 12 further comprising gripping means configured to maintain the position of a cloth resting on said porous sheet.

19. The cloth drying apparatus of claim 12 wherein said frame is formed by at least four segments of supporting bars connected with each other.

20. The cloth drying apparatus of claim 12 wherein the width of said frame is greater or equal to 20 inches and the height of said frame is greater or equal to 30 inches.

21. The cloth drying apparatus of claim 12 further comprising a garment hanger to form a kit; said garment hanger comprises:

a medial portion;

first and second supporting arms extending in opposite direction at an obtuse angle from said medial portion;

first and second movable arms configured to travel along said first and second supporting arms for defining an adjustable garment supporting width; and first and second linkage tongues, each having a remote end connected to said movable arms and a proximal region coupled to the medial portion of said hanger for reciprocally adjusting the position of said movable arms.

22. The cloth drying apparatus of claim 12 further comprising a garment hanger to form a kit, said garment hanger comprises:

a medial portion;

first and second supporting arms extending in opposite direction at an obtuse angle from said medial portion;

first and second movable arms configured to travel along said first and second supporting arms for defining an adjustable garment supporting width; and a knob located proximate to said medial portion for adjusting the position of said movable arms.

23. A cloth drying apparatus comprising a variable size frame structured to provide an expanded size drying mode and a reduced size storage mode; said frame is also structured to stand at an acute angle from a supporting surface during said expanded size drying mode;

a porous sheet structured to be stretched by said frame in said expanded size drying mode; said sheet is also configured to be released by a user from a stretched condition to provide said reduced size storage mode; and a garment hanger provided for said variable size frame to support a garment during said expanded size drying mode; said garment hanger comprises first and second supporting arms extending in opposite direction at an obtuse angle from a medial portion; said garment hanger further comprises a pair of movable arms traveling along said supporting arms for defining a garment supporting width.

24. The cloth drying apparatus of claim 23 wherein each of said movable arms having a remote region remote from said medial portion and a proximal terminal closer to said medial portion; and first and second linkage tongues, each having a remote end connected to said movable arms and a proximal region coupled to the medial portion of said hanger for reciprocally adjusting the position of said movable arms.

25. The cloth drying apparatus of claim 23 wherein said garment hanger further comprises:

a knob located proximate to said medial portion for adjusting the position of said movable arms.

* * * * *